US008356694B2

(12) United States Patent
Jones

(10) Patent No.: US 8,356,694 B2
(45) Date of Patent: Jan. 22, 2013

(54) RECIRCULATING LUBRICATION SYSTEM WITH SEALED LUBRICATION OIL STORAGE

(75) Inventor: Anthony C Jones, San Diego, CA (US)

(73) Assignee: Pratt & Whitney, East Hartford, CT (US)

( * ) Notice: Subject to any disclaimer, the term of this patent is extended or adjusted under 35 U.S.C. 154(b) by 638 days.

(21) Appl. No.: 11/895,961

(22) Filed: Aug. 28, 2007

(65) Prior Publication Data

US 2009/0057060 A1 Mar. 5, 2009

(51) Int. Cl.
*F01D 25/18* (2006.01)

(52) U.S. Cl. ..... 184/6.11

(58) Field of Classification Search ..... 184/6.11; 60/39.08

See application file for complete search history.

(56) References Cited

U.S. PATENT DOCUMENTS 4,170,873 A * 10/1979 Milo ..... 60/39.08
4,390,082 A * 6/1983 Swearingen ..... 184/6.4
4,452,037 A * 6/1984 Waddington et al. ..... 60/39.08
4,511,016 A * 4/1985 Doell ..... 184/6.11
4,619,284 A * 10/1986 Delarue et al. ..... 137/67
7,426,834 B2 * 9/2008 Granitz et al. ..... 60/772
2005/0034924 A1 * 2/2005 James et al. ..... 184/6.4
2006/0081419 A1 * 4/2006 Care et al. ..... 184/6.11
2008/0127627 A1 * 6/2008 Jewess et al. ..... 60/39.08
2008/0135336 A1 * 6/2008 Jewess et al. ..... 184/6.11
2008/0264726 A1 * 10/2008 Cornet et al. ..... 184/6.11

FOREIGN PATENT DOCUMENTS

EP 1936122 A1 * 12/2006

* cited by examiner

*Primary Examiner* — William E Dondero
*Assistant Examiner* — Robert T Reese
(74) *Attorney, Agent, or Firm* — Stephen G. Mican

(57) ABSTRACT

A recirculating lubrication system for a gas turbine engine comprises: a storage reservoir for storing a quantity of lubrication oil for the engine; an operating reservoir for supplying lubrication oil for the engine; a transfer valve with an inlet coupled to an outlet of the storage reservoir and an outlet coupled to an inlet of the operating reservoir to transfer the quantity of lubrication oil from the storage reservoir to the operating reservoir before starting the engine; and a pump for circulating the transferred lubrication oil through at least one engine bearing and back to the operating reservoir.

21 Claims, 3 Drawing Sheets

RECIRCULATING LUBRICATION SYSTEM WITH SEALED LUBRICATION OIL STORAGE

FIELD OF THE INVENTION

The invention relates to lubrication systems for engines, and more particularly to recirculating lubrication systems for gas turbine engines.

BACKGROUND OF THE INVENTION

Gas turbine engines for short-life expendable applications commonly employ rolling element bearings to journal rotating engine parts. Adequate lubrication of such bearings is essential to meeting designed life and reliability requirements. Long-life non-expendable engines use recirculating oil lubrication systems to secure optimal bearing life. However, such recirculating oil systems are not suitable for expendable engines due to their complexity, weight and cost.

Expendable short-life engines also have design requirements that include maintenance-free long-term storage without servicing prior to use. Conventional recirculating oil lubrication systems generally exhibit some degree of oil leakage with long-term storage or when stored in non-upright attitudes.

One example of a lubrication system for expendable engines that does not incur the limitations of complexity, weight, cost, leakage and restricted storage conditions of recirculating oil lubrication systems is a so-called "constant loss" non-recirculating lubrication system. It comprises an oil reservoir and a simple delivery mechanism. The delivery mechanism supplies oil to the bearings that flows through them and then through the engine flow path. There is no recirculation of the supplied oil so that lubrication only continues as long as the reservoir can deliver oil. The advantages of this system comprise its simplicity the excellent lubrication qualities of the oil that it delivers. The limited operating time restricted by the size of the reservoir and the potential for reservoir leakage offset these advantages.

Another example of a lubrication system for expendable engines is a fuel lubricant non-recirculating lubrication system. With this system, fuel supplies and lubricates the bearings and then passes through the engine flow path. This system has the advantages of simplicity and elimination of possible lubricant leakage. However, the poor lubrication qualities of the fuel offset these advantages.

SUMMARY OF THE INVENTION

The invention generally comprises a recirculating lubrication system for a gas turbine engine, comprising: a storage reservoir for storing a quantity of lubrication oil for the engine; an operating reservoir for supplying lubrication oil for the engine; a transfer valve with an inlet coupled to an outlet of the storage reservoir and an outlet coupled to an inlet of the operating reservoir to transfer the quantity of lubrication oil from the storage reservoir to the operating reservoir before starting the engine; and a pump for circulating the transferred lubrication oil through at least one engine bearing and back to the operating reservoir.

DETAILED DESCRIPTION OF THE INVENTION

Figure 1:
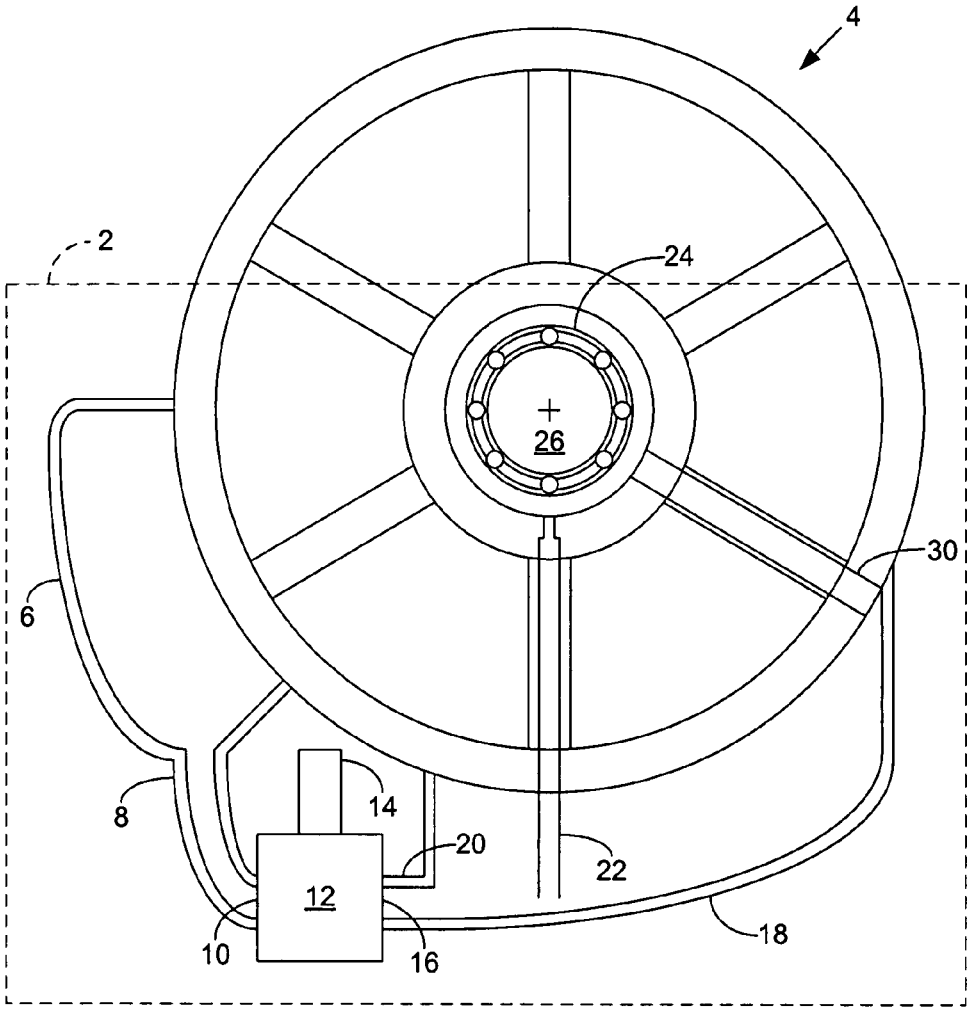
FIG. 1 is a front cut-away view of a recirculating oil lubrication system for a gas turbine engine according to a possible embodiment of the invention.
Figure 2:
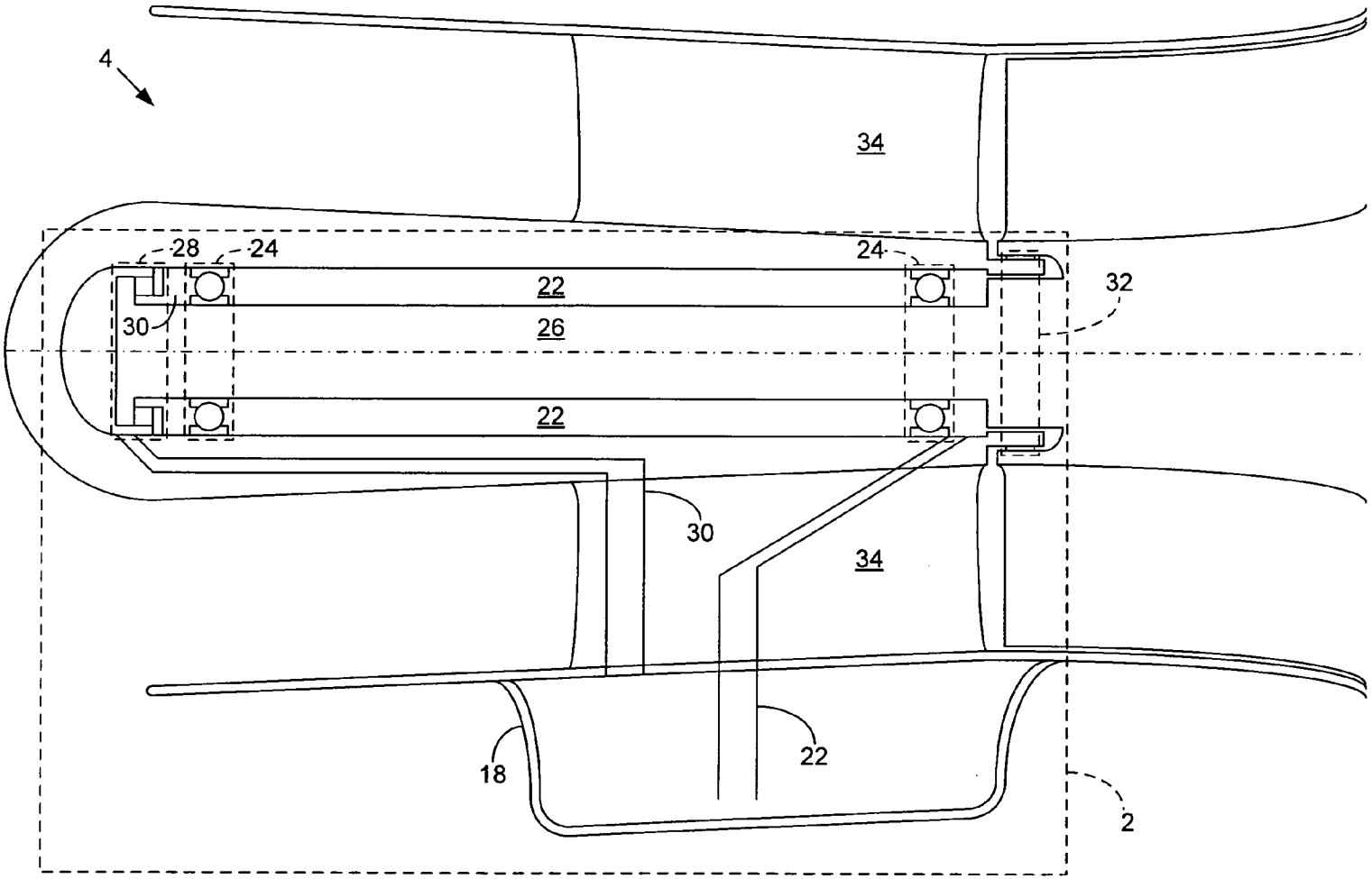
FIG. 2 is a side cut-away view of a recirculating oil lubrication system for a gas turbine engine according to a possible embodiment of the invention.
Figure 3:
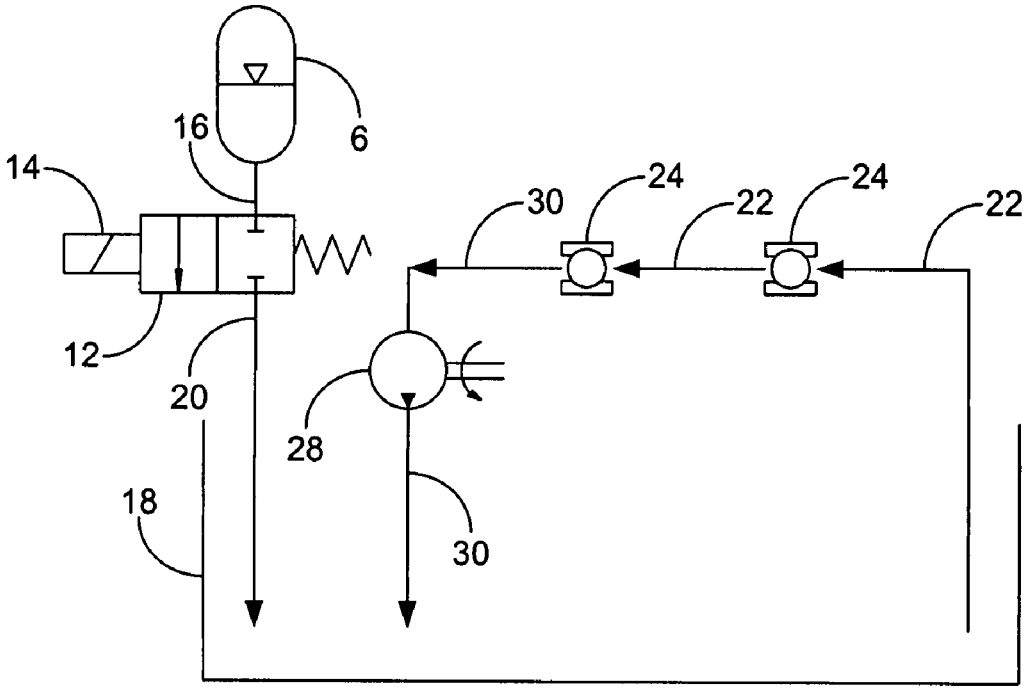
FIG. 3 is a schematic diagram of a recirculating oil lubrication system according to a possible embodiment of the invention.

FIGS. 1 and 2 are front and side cut-away views, respectively, of a recirculating oil lubrication system 2 for a gas turbine engine 4 according to a possible embodiment of the invention. FIG. 3 is a schematic diagram of the recirculating oil lubrication system 2 according to a possible embodiment of the invention. Referring to FIGS. 1 through 3 together, a storage reservoir 6 stores a quantity of lubrication oil for the engine 4 whilst the engine 4 is in storage. The storage reservoir 6 has an outlet 8 coupled to an inlet 10 of a two-way transfer valve 12. The storage reservoir 6 may comprise a pressurised vessel, such as a gas pressurised accumulator, wherein its outlet 8 may release lubrication oil under pressure, or an unpressurised vessel wherein its outlet 8 may release lubrication oil by means of gravity.

The transfer valve 12 normally remains shut to retain the lubrication oil within the storage reservoir 6 during storage of the engine 4. The transfer valve 12 has an operator 14 that opens the transfer valve 12 to release oil from the storage reservoir 6 through an outlet 16 of the transfer valve 12 a short time, such as a few seconds, before starting the engine 4. The operator 14 may be a solenoid operator, as shown, or another convenient type of operator, such as a pyrotechnic or pressure activated operator.

An operating reservoir 18 has an inlet 20 coupled to the transfer valve outlet 16 to let oil released from the storage reservoir 6 to fill the operating reservoir 18 when the transfer valve 12 opens. An engine lubrication oil supply path 22 permits flow of lubrication oil in the operating reservoir 18 to at least one engine bearing 24 that journals at least one engine part 26, such as an engine shaft. After the engine 4 starts, a pump 28, such as an engine shaft mounted slinger pump as shown in FIG. 2, circulates lubrication oil in the operating reservoir 18 through each bearing 24 by means of at least one lubrication supply path 22. Alternatively, the pump 28 may be a different type of pump otherwise coupled to the engine 4 or it could be an electrically powered pump. An engine lubrication oil discharge path 30 returns circulated lubrication oil back to the operating reservoir 18.

The pump 28 may operate as a conventional pressure pump by drawing oil at low pressure from the operating reservoir 18 and delivering it to metering jets (not shown) at increased pressure and hence to the bearings 24, in which case the operating reservoir 18 may or may not be vented to atmosphere. Alternatively the pump 28 may operate as a scavenge pump drawing a mixture of air and lubrication oil from the lubrication oil discharge path 30 and delivering it to the operating reservoir 18 at increased pressure. The operating reservoir 18 then delivers pressurised oil to the metering jets and hence to the bearings 24.

At least one seal 32 may prevent lubrication oil from escaping to a flow path 34 for the engine 4. Each seal 32 may employ any suitable sealing system known in the art, but a "windback" sealing system is ideal due to its simplicity and low cost. Absolute sealing is not necessary if the quantity of lubrication oil stored in the storage reservoir and transferred to the operating reservoir is sufficient to accommodate a small amount of leakage during a predetermined operating period of the engine 4.

The described embodiments of the invention are only some illustrative implementations of the invention wherein changes and substitutions of the various parts and arrangement thereof are within the scope of the invention as set forth in the attached claims.

The claimed invention is:

1. A lubrication system for an expendable gas turbine engine that recirculates lubrication oil through the engine, comprising:

a single port storage reservoir that stores all of the lubrication oil for the engine and isolates all the lubrication oil from the engine before starting the engine;

an operating reservoir that supplies all of the lubrication oil from the storage reservoir for the engine after starting the engine;

a transfer valve with an inlet coupled to the single port of the storage reservoir and an outlet coupled to an inlet of the operating reservoir that transfers all of the lubrication oil from the storage reservoir through its single port to the operating reservoir before starting the engine and blocks the return of the lubrication oil to the storage reservoir through its single port during operation of the engine; and a pump that circulates the lubrication oil from the operating reservoir through at least one engine bearing by means of an engine lubrication oil supply path and back to the operating reservoir by means of an engine lubrication oil discharge path separate from the engine lubrication oil supply path.

2. The lubrication system of claim 1, wherein each engine bearing journals an engine part.

3. The lubrication system of claim 2, wherein a journaled engine part drives the pump.

4. The lubrication system of claim 1, wherein the transfer valve has a solenoid operator.

5. The lubrication system of claim 1, wherein the transfer valve has a pyrotechnic operator.

6. The lubrication system of claim 1, wherein the transfer valve has a pressure activated operator.

7. The lubrication system of claim 1, wherein the storage reservoir stores sufficient lubrication oil to lubricate each engine bearing for a predetermined operating period of the engine.

8. The lubrication system of claim 1, wherein the storage reservoir comprises a hydraulic accumulator.

9. The lubrication system of claim 8, wherein the hydraulic accumulator is a gas-pressurised hydraulic accumulator.

10. The lubrication system of claim 1, wherein the storage reservoir comprises an unpressurised vessel.

11. An expendable gas turbine engine with at least one engine bearing and a lubrication system that lubricates each engine bearing, comprising:

a single port storage reservoir that stores all of the lubrication oil for the engine and isolates all the lubrication oil from the engine before starting the engine;

an operating reservoir that supplies all of the lubrication oil from the storage reservoir for the engine after starting the engine;

a transfer valve with an inlet coupled to the single port of the storage reservoir and an that transfers all of the lubrication oil from the storage reservoir through its single port to the operating reservoir before starting the engine and blocks the return of the lubrication oil to the storage reservoir through its single port during operation of the engine; and a pump that circulates the lubrication oil from the operating reservoir through at least one engine bearing by means of an engine lubrication oil supply path and back to the operating reservoir by means of an engine lubrication oil discharge path separate from the engine lubrication oil supply path.

12. The engine of claim 11, wherein each engine bearing journals an engine part.

13. The engine of claim 12, wherein a journaled engine part drives the pump.

14. The engine of claim 11, wherein the transfer valve has a solenoid operator.

15. The engine of claim 11, wherein the transfer valve has a pyrotechnic operator.

16. The engine of claim 11, wherein the transfer valve has a pressure activated operator.

17. The engine of claim 11, wherein the storage reservoir stores sufficient lubrication oil to lubricate each engine bearing for a predetermined operating period of the engine.

18. The engine of claim 11, wherein the storage reservoir comprises a pressurised vessel.

19. The engine of claim 18, wherein the storage reservoir is a gas-pressurised hydraulic accumulator.

20. The engine of claim 11, wherein the storage reservoir comprises an unpressurised vessel.

21. A method of recirculating lubrication oil through at least one engine bearing for an expendable gas turbine engine that incorporates the steps of:

sealing all of the lubrication oil for the engine from the engine in a storage location that has a single lubrication oil transfer point before starting the engine;

transferring all of the lubrication oil from the storage location through the single transfer point of the storage location before starting the engine to an operating location;

blocking the single transfer point to prevent the return of the lubrication oil to the storage location during operation of the engine; and circulating the lubrication oil from the operating location to each engine bearing through an engine lubrication oil supply path and back to the operating location through an engine lubrication oil discharge path separate from the engine lubrication oil supply path.

* * * * *